US005854518A

United States Patent [19]

Revis

[11] Patent Number: 5,854,518

[45] Date of Patent: Dec. 29, 1998

[54] INLINE CONDENSATION ALARM SYSTEM FOR A CENTRAL AIR CONDITIONING UNIT

[76] Inventor: Billy Wayne Revis, P.O. Box 10038, Killeen, Tex. 76547

[21] Appl. No.: 27,733

[22] Filed: Feb. 23, 1998

[51] Int. Cl.[6] ..... H01H 35/18

[52] U.S. Cl. ..... 307/118; 62/129; 340/620

[58] Field of Search ..... 307/118, 112, 307/116; 340/604, 602, 620, 618; 361/178; 417/19, 20, 30; 73/53.04, 304 R; 62/129

[56] References Cited

U.S. PATENT DOCUMENTS

| | | | |
|---|---|---|---|
| 3,757,316 | 9/1973 | Fiorenzo | 340/620 |
| 4,633,673 | 1/1987 | Morrison et al. | 62/129 |
| 4,673,925 | 6/1987 | Whiteman | 340/620 |
| 4,937,559 | 6/1990 | Meacham et al. | 340/618 |
| 5,126,097 | 6/1992 | Weng et al. | 307/118 |
| 5,365,220 | 11/1994 | Rasmason | 340/620 |
| 5,522,229 | 6/1996 | Stuchlik, III et al. | 340/620 |
| 5,755,105 | 5/1998 | Lacoste | 340/620 |

*Primary Examiner*—Richard T. Elms

[57] ABSTRACT

An inline condensation alarm system used to detect condensation backup within the condensation line of a central air conditioning unit. The two stainless steel screws complete a circuit between the piezo buzzer and battery within the PVC pipe installed to the condensation line of the unit. Once condensation backs up to the top contact point the alarm is set off. The alarm would allow time for the user to clear the blockage prior to spillover from the condensation line.

1 Claim, 4 Drawing Sheets

INLINE CONDENSATION ALARM SYSTEM FOR A CENTRAL AIR CONDITIONING UNIT

INLINE CONDENSATION ALARM SYSTEM FOR A CENTRAL AIR CONDITIONING UNIT

INLINE CONDENSATION ALARM SYSTEM FOR A CENTRAL AIR CONDITIONING UNIT

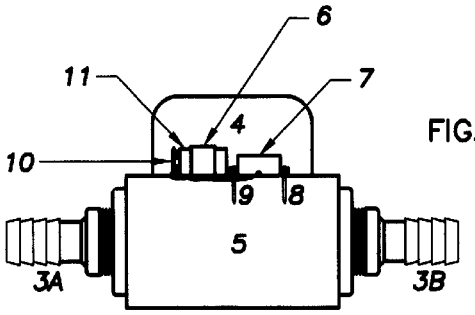
FIG. 3A
FIG. 3B
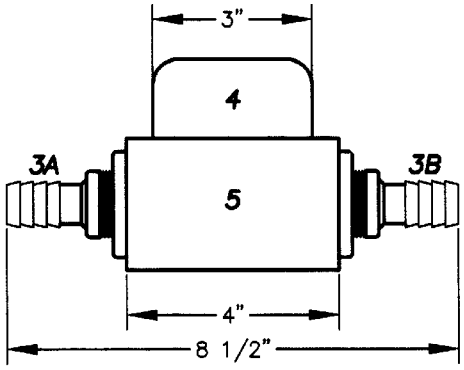
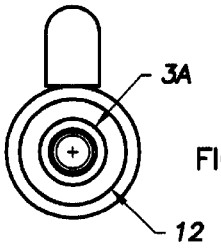
FIG. 3C
INLINE CONDENSATION ALARM SYSTEM FOR A CENTRAL AIR CONDITIONING UNIT

INLINE CONDENSATION ALARM SYSTEM OR A CENTRAL AIR CONDITIONING UNIT

INLINE CONDENSATION ALARM SYSTEM FOR A CENTRAL AIR CONDITIONING UNIT

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A MICROFICHE APPENDIX

NOT APPLICABLE

BACKGROUND OF THE INVENTION

This invention relates to the condensation line of an interior central air conditioning system.

When a central air conditioning system runs it causes condensation within the unit. This condensation is designed to drain from the unit through a line extending from the unit to the outside of the building.

Occasionally the line gets stopped up and the water backs up into the interior unit and spills over and leaks into the building. If left undetected this leakage can cause damage to the unit, the closet which houses the unit, and any floor coverings surrounding the unit.

BRIEF SUMMARY OF THE INVENTION

This invention is directed to a water alarm system for the condensation line of a central air conditioning unit. The object of the present invention is to provide a warning system prior to any leakage from the condensation line.

The inline condensation alarm system comprises two stainless steel screws acting as a sensor, circuitry, alarm, and power supply housing fitted within a PVC bushing with male hose adapters on each end. After being installed to the condensation line the alarm will sound if the water reaches the sensor being the two contact points. This would signal users of an impending leak prior to it occuring, giving them enough time to rectify the problem.

BRIEF DESCRIPTION OF THE SEVERAL VIEWS OF THE DRAWING

FIGS. 3A, 3B, 3C are a more detailed view of the inline condensation alarm system, showing size, dimensions, and parts necessary to build the alarm system.

DETAILED DESCRIPTION OF THE INVENTION

Figure 1:
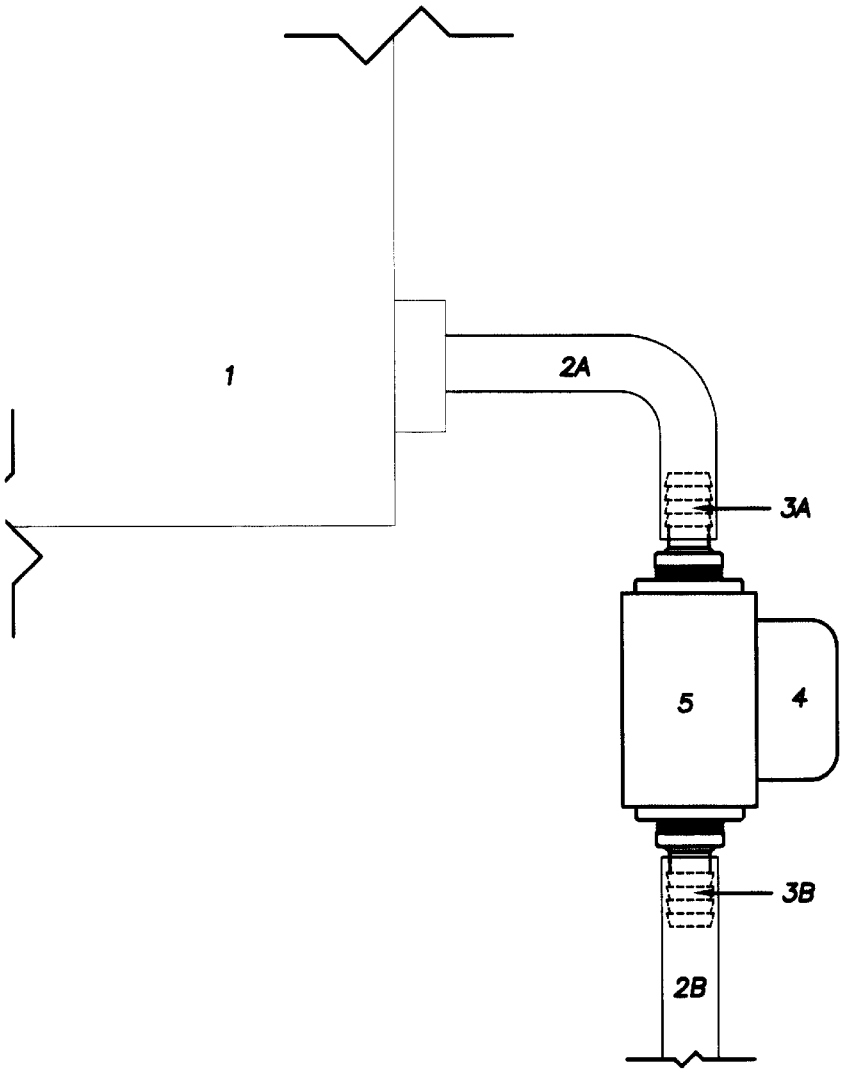
FIG. 1 is a perspective view of the inline condensation alarm system as the invention is used on the existing air conditioning unit to alarm users of a possible blockage to the condensation line of the central air conditioning unit.
Figure 2:
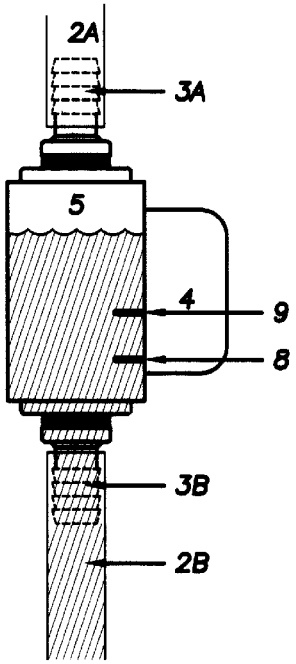
FIG. 2 is a interior view of the inline condensation alarm system showing how the water backs up within the condensation line and then creates a complete circuit between the contact points and sounds the alarm.

Referring to FIG. 1, this invention was designed to be installed into the air conditioning 1 condensation drain line 2A 2B. This drain line 2A 2B is usually made from a rubber type hose and can be easily cut away to install the unit. The alarm system, once installed would sound an alarm warning the user that the water in the condensation line 2A 2B of the air conditioning unit 1 is backing up. Early detection is the key in avoiding leakage and damage, plus reduces expensive repair costs. As in FIG. 2, once the water in the line reaches the second contact point 9 within the unit 5, it completes the circuit between the first 8 and second 9 contact points and sounds the alarm 11 warning users of the water level. This pulsing piezo buzzer alarm 11 is attached to the PVC pipe with the two 1 inch stainless steel screws 8 9 which act as the contact points and the alarm is operated by a 9 volt battery 7 which is also housed within the alarm housing 4. Once the alarm has sounded, one could then remove the bottom hose 2B from the alarm system 3B and clear the condensation line 2B of the obstruction prior to any condensation leaking outside of the unit.

Figure 4:
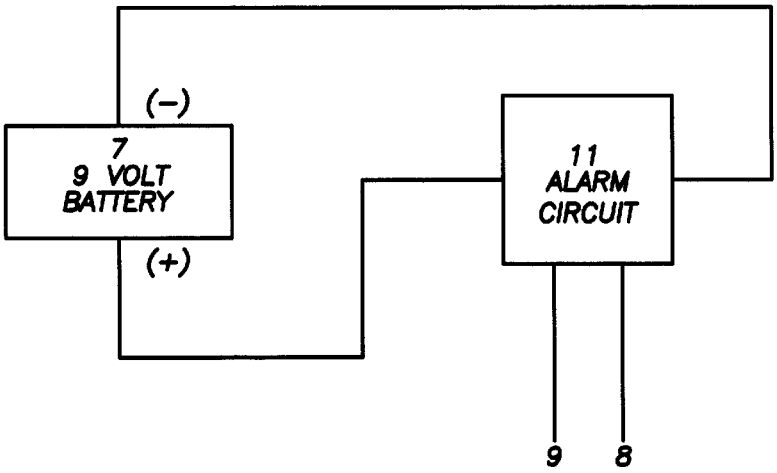
FIG. 4 is an electrical schematic of the present invention.

FIGS. 3A, 3B, 3C, detail the invention itself showing the male ends 3A 3B, condensation reservoir 5, alarm 11 contact points 8 9, power source 7, and housing 4, FIG. 4 diagrams electrical schematic for said invention showing the electrical interconnection of the 9 volt battery 7, the alarm circuit 11 and contact points 8,9.

I claim:

1. An alarm system for detecting condensation backup within a condensation drain line hose of a central air conditioning unit and for sounding an alarm to notify one of a possible blockage comprising:

said condensation drain lime hose having first and second sections, said first section having a first end coupled to the central air conditioning unit and a second end, said second section having first end for draining central air conditioning unit condensation and a second end, a PVC pipe having threaded splined male hose adapters on each end which is inserted into the condensation drain line hose by inserting the threaded splined male hose adapters into the second ends of the first and second sections of the condensation drain line hose, the PVC pipe containing upper and lower stainless steel screw contact points which are electrically coupled to an alarm circuit which sounds a piezo buzzer when both the upper and lower stainless steel screw contact points contact backed-up condensation in the condensation drain line hose, a PVC housing containing the alarm circuit attached to an external surface of the PVC pipe, wherein the alarm circuit comprises a 9 volt battery, the piezo buzzer and an electrical connection to the upper and lower stainless steel screw contact points electrically connected so as to sound the piezo buzzer when both the upper and lower stainless steel screw contact points contact backed-up condensation in the condensation drain line hose.

* * * * *